US011267682B2

(12) United States Patent
Huang

(10) Patent No.: US 11,267,682 B2
(45) Date of Patent: Mar. 8, 2022

(54) POSITION ADJUSTMENT MECHANISM FOR LIFTING BALANCE DEVICE

(71) Applicant: Hsien-Ta Huang, Taoyuan (TW)

(72) Inventor: Hsien-Ta Huang, Taoyuan (TW)

( * ) Notice: Subject to any disclaimer, the term of this patent is extended or adjusted under 35 U.S.C. 154(b) by 198 days.

(21) Appl. No.: 16/689,070

(22) Filed: Nov. 19, 2019

(65) Prior Publication Data

US 2020/0180922 A1 Jun. 11, 2020

(30) Foreign Application Priority Data

Dec. 5, 2018 (TW) ..... 107143878

(51) Int. Cl.
*B66F 7/06* (2006.01)
*B66F 7/28* (2006.01)
*A47G 9/10* (2006.01)

(52) U.S. Cl.
CPC ..... *B66F 7/065* (2013.01); *B66F 7/0625* (2013.01); *B66F 7/28* (2013.01); *A47G 9/10* (2013.01)

(58) Field of Classification Search
CPC ..... B66F 7/065; B66F 7/0625; B66F 7/28; B66F 3/28; B66F 3/30; B66F 17/00; B66F 17/006; B66F 7/08; A47G 9/10
See application file for complete search history.

(56) References Cited

U.S. PATENT DOCUMENTS 5,285,992 A * 2/1994 Brown ..... B66F 7/0608 108/147
7,111,825 B2 * 9/2006 Landsberger ..... B01L 9/00 254/122
7,552,683 B2 * 6/2009 Hayashi ..... B66F 7/065 104/89
10,544,019 B2 * 1/2020 Kochie ..... B66F 7/065
2018/0118539 A1 * 5/2018 Kritzer ..... B66F 7/28

* cited by examiner

*Primary Examiner* — Seahee Hong
(74) *Attorney, Agent, or Firm* — Chun-Ming Shih; HDLS IPR Services

(57) ABSTRACT

A position adjustment mechanism for a lifting balance device contains: a first cover and an adjustment device. The first cover includes at least one lifting balance device, and each of the at least one lifting balance device includes a first support, a second support intersected with the first support, and a first shaft configured to connected the first and second supports. The first support includes a first roller arranged on a first end thereof adjacent to the first cover and accommodated in a first track groove on the first cover. The first track groove has the adjustment device arranged therein opposite to the first roller, such that the adjustment device is adjustable to limit a highest lifting position of each of the first support and the second support.

4 Claims, 6 Drawing Sheets

POSITION ADJUSTMENT MECHANISM FOR LIFTING BALANCE DEVICE

FIELD OF THE INVENTION

The present invention relates to a position adjustment mechanism which is fixed below a lifting balance device of a pillow so as to adjust the pillow to a highest lifting height based on using requirements.

BACKGROUND OF THE INVENTION

It is essential for people to adjust a height of a pillow when sleeping on their backs or on their sides. However, the pillow cannot be adjusted to a desired height.

A conventional adjustable pillow has been developed, but it can only be adjustably lifted to a fixed height. In other words, the conventional adjustable pillow cannot be adjusted to a highest lifting height based on using requirements.

The present invention has arisen to mitigate and/or obviate the afore-described disadvantages.

SUMMARY OF THE INVENTION

The primary aspect of the present invention is to provide a position adjustment mechanism which is fixed below a lifting balance device of a pillow so as to adjust the pillow to a highest lifting height based on using requirements.

Another aspect of the present invention is to provide a position adjustment mechanism which is capable of adjusting the highest lifting position of each lifting balance device by rotating the tangent planes of the adjustment device in the first track groove.

To obtain above-mentioned aspects, a position adjustment mechanism provided by the present invention contains: a first cover in which at least one lifting balance device is arranged, and each of the at least one lifting balance device including a first support, a second support intersected with the first support, and a first shaft configured to connected the first support and the second support.

The first support includes a first roller arranged on a first end thereof adjacent to the first cover and accommodated in a first track groove on the first cover;

The first track groove has an adjustment device arranged therein opposite to the first roller, such that the adjustment device is adjustable to limit a highest lifting position of each of the first support and the second support.

Preferably, the first support includes a second shaft fixed on a second end thereof and rotatably connected with a positioning plate; the second support includes a third shaft rotatably fixed on a first end thereof adjacent to the first cover, and the second support includes a second roller arranged on a second end thereof and accommodated in a second track groove below the second cover.

Preferably, the first track groove has a first stop block and a second stop block mounted on two ends of the first track groove respectively.

Preferably, the first track groove includes an opening defined on a bottom thereof proximate to the second stop block, the opening accommodates the adjustment device, and the adjustment device is rotated on the opening.

Preferably, the adjustment device is formed on a column shape, and the adjustment device includes a fourth shaft disposed on a top thereof and includes a rotation portion arranged on a bottom of the adjustment device; the adjustment device further includes multiple tangent plane arranged on a peripheral side thereof, wherein multiple distances between the multiple tangent plane and a center of the adjustment device are different.

Preferably, the rotation portion has an engagement portion extending from a bottom of the rotation portion.

Preferably, the second stop block has an arcuate face defined thereon facing the first stop block, and a limiting extension is secured on the arcuate face; the adjustment device includes a defining slot defined on the peripheral side of the adjustment device and contacting with the arcuate face of the second stop block so that the defining slot rotates within a predetermined angle relative to the limiting extension.

DETAILED DESCRIPTION OF THE PREFERRED EMBODIMENTS

Figure 1:
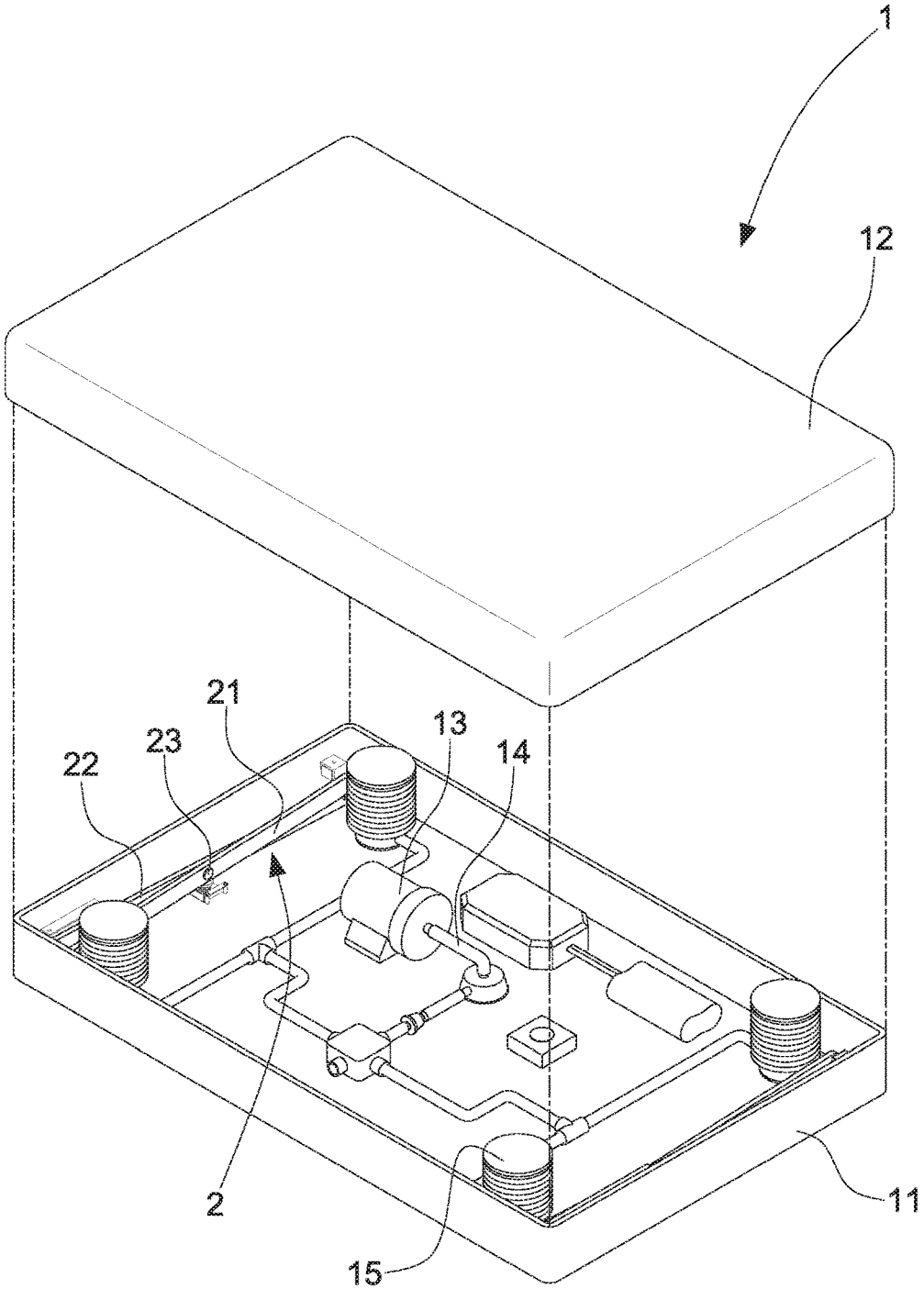
FIG. 1 is a perspective view showing the application of a position adjustment mechanism for a lifting balance device according to a preferred embodiment of the present invention.
Figure 2:
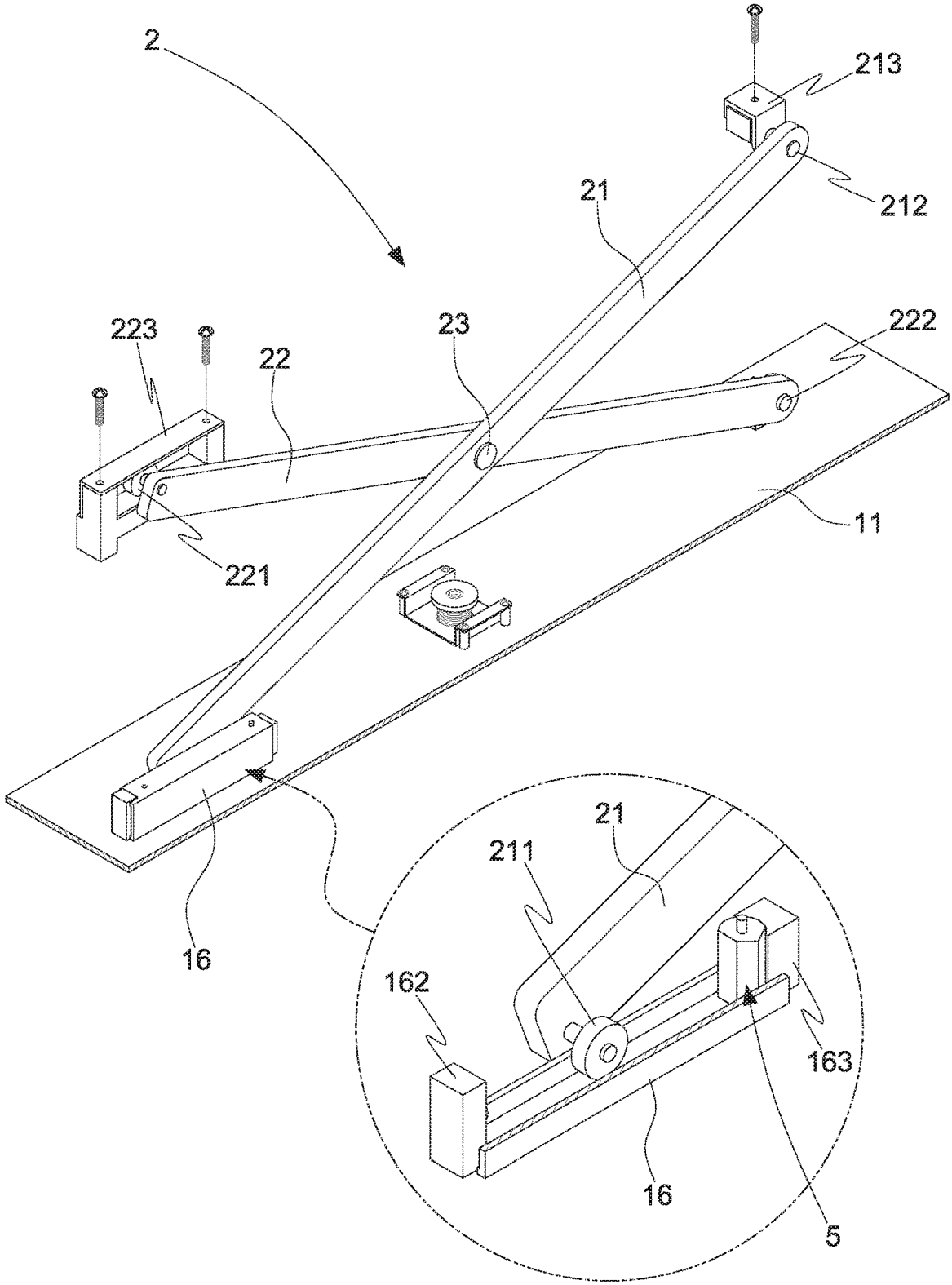
FIG. 2 is a perspective view showing the assembly of the position adjustment mechanism for the lifting balance device according to the preferred embodiment of the present invention.
Figure 3:
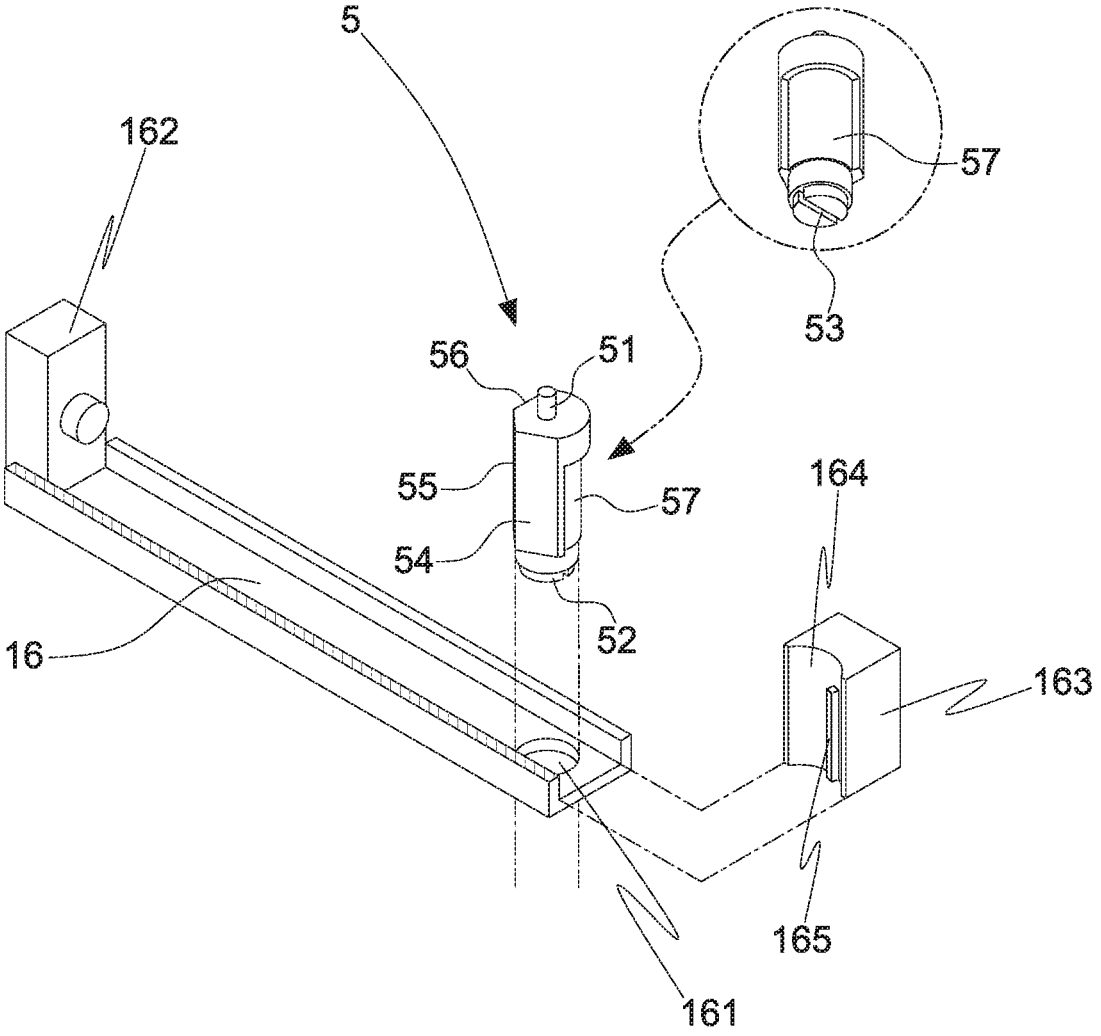
FIG. 3 is a perspective view showing the exploded components of a part of the position adjustment mechanism for the lifting balance device according to the preferred embodiment of the present invention.

With reference to FIGS. 1-4, a position adjustment mechanism for a lifting balance device according to a preferred embodiment of the present invention comprises: an adjustable pillow 1 including a first cover 11, a second cover 12, an air pump 13 defined between the first cover 11 and the second cover 12, multiple air pipes 14, multiple capsules 15, and two lifting balance devices 2.

Each of the two lifting balance devices 2 includes a first support 21, a second support 22 intersected with the first support 21, and a first shaft 23 configured to connected the first support 21 and the second support 23.

The first support 21 includes a first roller 211 arranged on a first end thereof adjacent to the first cover 11 and accommodated in a first track groove 16 on the first cover 11. The first support 21 includes a second shaft 212 fixed on a second end thereof and rotatably connected with a positioning plate 213. The second support 22 includes a third shaft 222 rotatably fixed on a first end thereof adjacent to the first cover 11. The second support 22 includes a second roller 221 arranged on a second end thereof and accommodated in a second track groove 223 below the second cover 12. The first track groove 16 has an adjustment device 5 arranged therein opposite to the first roller 211, such that the adjustment device 5 is adjustable to limit a highest lifting position of each of the first support 21 and the second support 22.

The first track groove 16 has a first stop block 162 and a second stop block 163 mounted on two ends of the first track groove 16 respectively, wherein the second stop block 163 has an arcuate face 164 defined thereon facing the first stop block 162, and a limiting extension 165 is secured on the arcuate face 164; the first track groove 16 includes an opening 161 defined on a bottom thereof proximate to the second stop block 163, where the opening 161 accommodates the adjustment device 5, and the adjustment device 5 is rotated on the opening 161.

The adjustment device 5 is formed on a column shape, and the adjustment device 5 includes a fourth shaft 51 disposed on a top thereof, a rotation portion 52 arranged on a bottom of the adjustment device 5, and an engagement portion 53 extending from a bottom of the rotation portion 52. The adjustment device 5 further includes a first tangent plane 54, a second tangent plane 55, and a third tangent plane 56 which are arranged on a peripheral side of the adjustment device 5, wherein a distance between the first tangent plane 54 and a center of the adjustment device 5, a distance between the second tangent plane 55 and the center of the adjustment device 5, and a distance between the third tangent plane 56 and the center of the adjustment device 5 are different. Furthermore, the adjustment device 5 includes a defining slot 57 defined on the peripheral side of the adjustment device 5 and contacting with the arcuate face 164 of the second stop block 163 so that the defining slot 57 rotates within a predetermined angle relative to the limiting extension 165.

Figure 4:
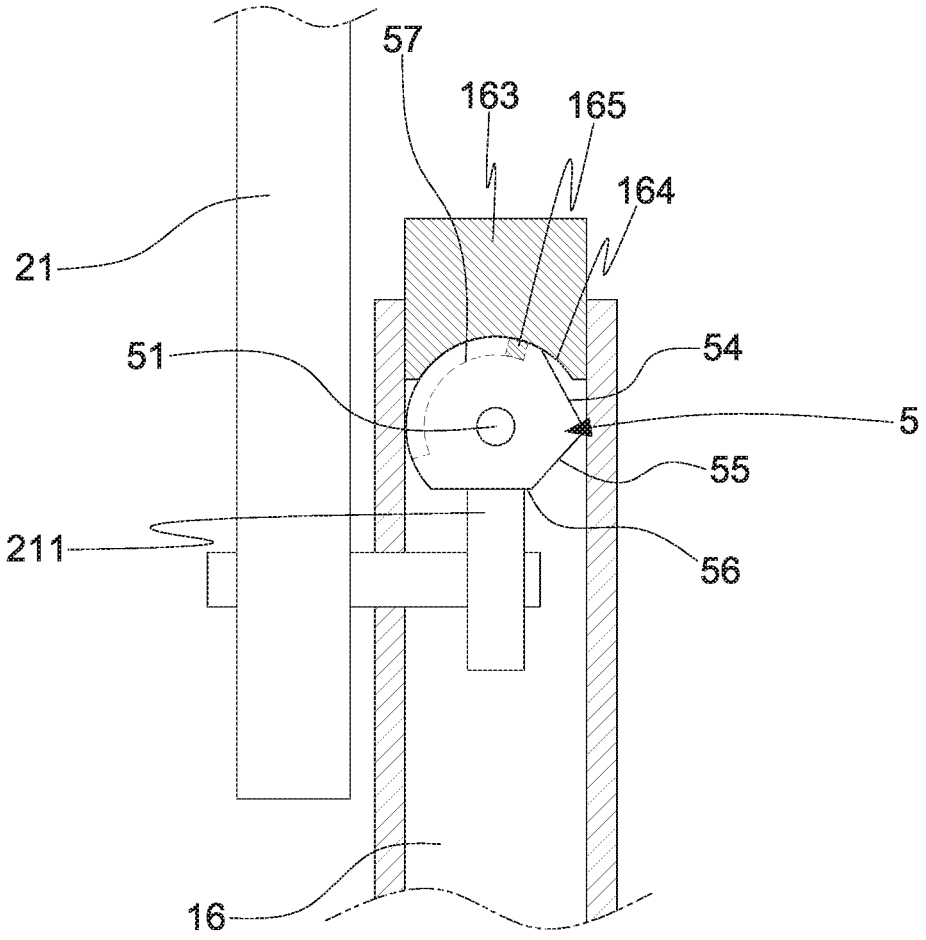
FIG. 4 is a cross sectional view showing the assembly of a part of the position adjustment mechanism for the lifting balance device according to the preferred embodiment of the present invention.
Figure 5:
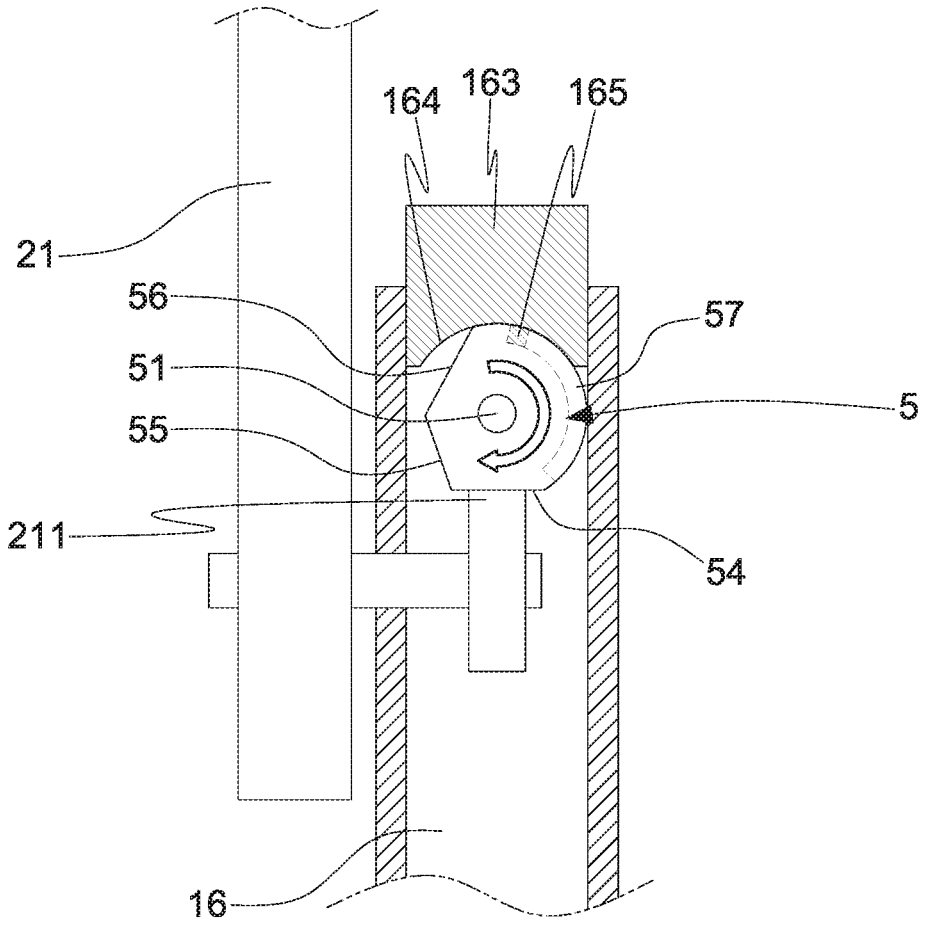
FIG. 5 is a cross sectional view showing the operation of a part of the position adjustment mechanism for the lifting balance device according to the preferred embodiment of the present invention.
Figure 6:
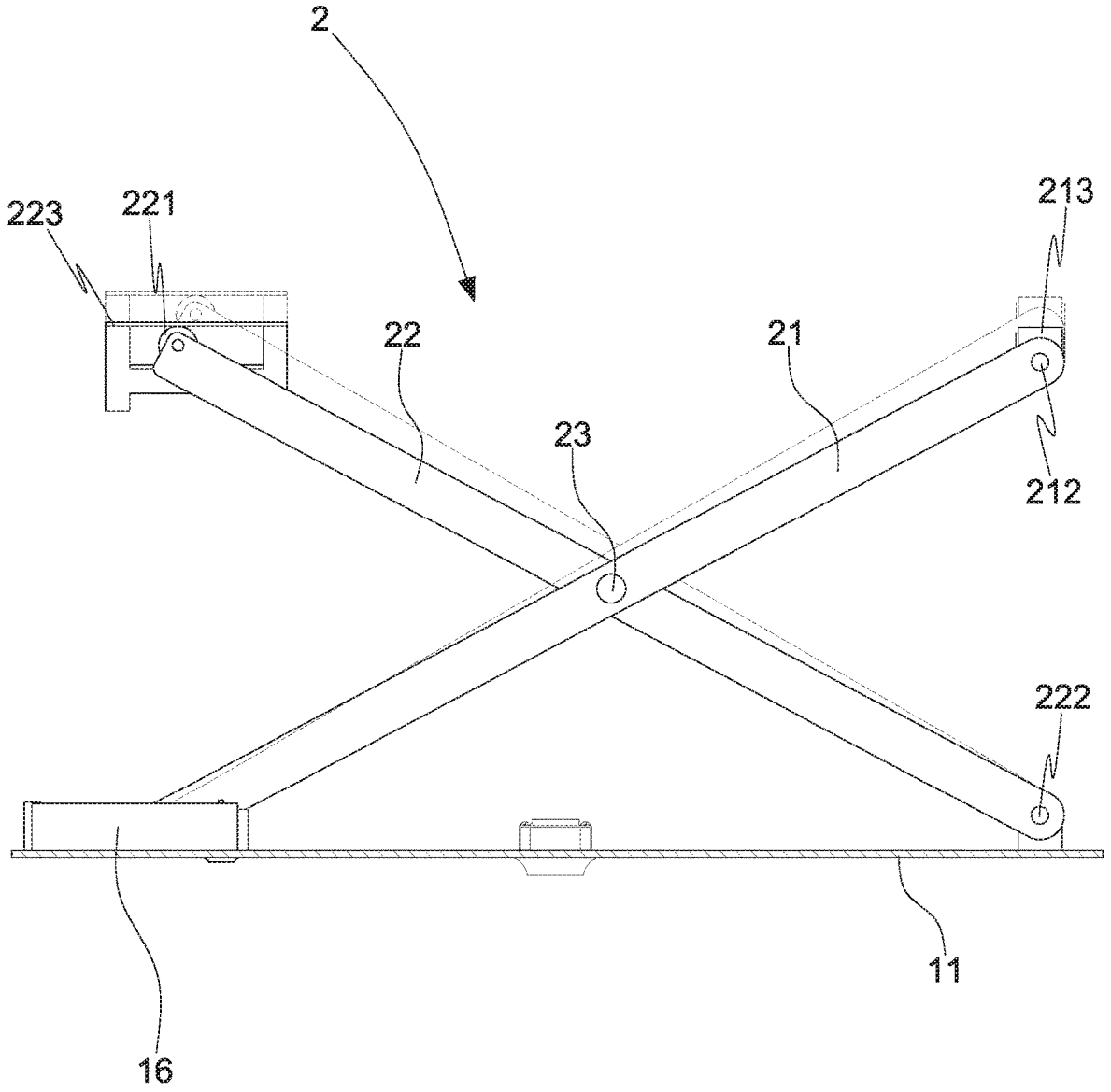
FIG. 6 is a side plan view showing the operation of the position adjustment mechanism for the lifting balance device according to the preferred embodiment of the present invention.

When desiring to lift each lifting balance device 2, the first roller 211 is moved to the second stop block 163 from the first stop block 162 until the first roller 211 is stopped by the adjustment device 5 (as shown in FIG. 4). The engagement portion 53 of the rotation portion 52 of the adjustment device 5 is rotated by using a coin or a screwdriver so as to change three position of the first tangent plane 54, the second tangent plane 55, and the third tangent plane 56 relative to the first roller 211 (as illustrated in FIG. 5). Since the distance between the first tangent plane 54 and the center of the adjustment device 5, the distance between the second tangent plane 55 and the center of the adjustment device 5, and the distance between the third tangent plane 56 and the center of the adjustment device 5 are different, the first roller 211 is stopped at three stop position, thus adjusting the highest lifting position of each lifting balance device 2 (as illustrated in FIG. 6).

In another embodiment, the adjustment device 5 includes more than three tangent planes.

Preferably, multiple fixing portions are arranged around the opening of the first cover so as to adjust the adjustment device with a user's eyes.

Accordingly, the highest lifting position of each lifting balance device is adjustable by rotating the tangent planes of the adjustment device in the first track groove.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A system comprising a position adjustment mechanism and a lifting balance device, wherein the position adjustment mechanism comprising a first cover in which the lifting balance device is arranged, and the lifting balance device including a first support, a second support intersected with the first support, and a first shaft configured to connected the first support and the second support;

wherein the first support includes a first roller arranged on a first end thereof adjacent to the first cover and accommodated in a first track groove on the first cover;

wherein the first track groove has an adjustment device arranged therein opposite to the first roller, such that the adjustment device is adjustable to limit a highest lifting position of each of the first support and the second support;

wherein the first support includes a second shaft fixed on a second end thereof and rotatably connected with a positioning plate; the second support includes a third shaft rotatably fixed on a first end thereof adjacent to the first cover, and the second support includes a second roller arranged on a second end thereof and accommodated in a second track groove below a second cover;

wherein the first track groove has a first stop block and a second stop block mounted on two ends of the first track groove respectively;

wherein the first track groove includes an opening defined on a bottom thereof proximate to the second stop block, the opening accommodates the adjustment device, and the adjustment device is rotated on the opening.

2. The system as claimed in claim 1, wherein the adjustment device is formed on a column shape, and the adjustment device includes a fourth shaft disposed on a top thereof and includes a rotation portion arranged on a bottom of the adjustment device; the adjustment device further includes multiple tangent planes arranged on a peripheral side thereof, wherein multiple distances between the multiple tangent planes and a center of the adjustment device are different.

3. The system as claimed in claim 2, wherein the rotation portion has an engagement portion extending from a bottom of the rotation portion.

4. The system as claimed in claim 2, wherein the second stop block has an arcuate face defined thereon facing the first stop block, and a limiting extension is secured on the arcuate face; the adjustment device includes a defining slot defined on the peripheral side of the adjustment device and contacting with the arcuate face of the second stop block so that the defining slot rotates within a predetermined angle relative to the limiting extension.

* * * * *